United States Patent [19]

Choung

[11] Patent Number: 4,834,442

[45] Date of Patent: May 30, 1989

[54] LIFTING CLAMP

[76] Inventor: Moon M. Choung, 33 Bramble La., Melville, N.Y. 11747

[21] Appl. No.: 163,582

[22] Filed: Mar. 3, 1988

[51] Int. Cl.[4] ..... B66C 1/48

[52] U.S. Cl. ..... 294/101; 294/104

[58] Field of Search ..... 294/101, 104, 114, 901, 294/902

[56] References Cited

U.S. PATENT DOCUMENTS

| | | | |
|---|---|---|---|
| 1,011,660 | 12/1911 | Strathern | 294/104 |
| 1,266,233 | 5/1918 | Eckerson | 294/114 |
| 2,308,485 | 1/1943 | Bass | 294/104 |
| 2,393,101 | 1/1946 | Gardner | 294/104 |
| 2,412,555 | 12/1946 | Baker | 294/104 |
| 3,300,242 | 1/1967 | Renfroe | 294/101 |

FOREIGN PATENT DOCUMENTS

| | | | |
|---|---|---|---|
| 2416189 | 10/1979 | France | 294/101 |

*Primary Examiner*—Johnny D. Cherry

*Attorney, Agent, or Firm*—Alan R. Thiele; Eddie E. Scott

[57] ABSTRACT

A device for lifting metal plate or the like includes a substantially U-shaped housing which contains a toothless eccentric cam and a shackle. The toothless eccentric cam is mounted to the shackle by use of a connecting link and a radius link. The radius link is pivotably mounted to the housing so that when force is exerted on the shackle, a force is then exerted on the radius link which causes the connecting link to rotate the toothless eccentric cam into the throat of the housing.

3 Claims, 1 Drawing Sheet

LIFTING CLAMP

BACKGROUND OF THE INVENTION

The present device pertains to lifting clamps; more particularly, the present invention relates to lifting clamps having the ability to exert enhanced or increased lifting forces.

Lifting clamps having a cam which is rotated into the side of a metal plate or the like have become well known. Such lifting clamps typically include a U-shaped housing and a shackle upon which a vertical force is exerted. The vertical force exerted on the shackle causes a cam to be rotated into the throat of the U-shaped housing and a force is thereby exerted against the side of the metal plate or the like to be lifted.

In order to increase the contact and the force exerted on the metal plate or the like, it has been found necessary to add teeth to the cam. Such teeth, will provide additional lifting force; however, they have the detriment of marring the surface of the metal plate or the like. Additionally, the interengagement of gripping teeth with metal may make the clamp difficult to release after the lifting operation has been completed.

There is therefore a need in the art to provide a lifting clamp which includes a toothless or non-marring cam so that the surface of the metal plate or the like will not be marred. There is also a need in the art to provide a lifting clamp wherein the lifting clamp mechanism is easily disengageable from the metal plate or the like.

SUMMARY OF THE INVENTION

A non-marring, easily disengageable lifting clamp for lifting metal plates or the like includes a U-shaped housing. The U-shaped housing is characterized by having two leg members, a base and a throat. A swivel pad is pivotably mounted on one of the leg members. Within the other leg member an eccentric cam is pivotably mounted. The metal plate or the like is lifted by causing the eccentric cam to rotate into the throat of the U-shaped housing. When a metal plate is located within the throat of the U-shaped housing, the entry of the cam into the throat of the U-shaped housing presses the metal plate or the like against the swivel pad mounted on the opposite leg of the housing. Enhanced gripping forces are obtained by the use of a connecting mechanism including a radius link.

The connecting mechanism includes a connecting link pivotably mounted to the cam to move the cam into the throat of the clamp. Attached to the connecting link is a radius link. The radius link is pivotably mounted to the housing and also to the lifting shackle. Therefore, when a force is exerted on the lifting shackle, the radius link rotates with respect to the housing. This rotation causes the connecting link to move. The movement of the connecting link causes the eccentric cam to move and consequently to exert force on the metal plate or the like which is located in the throat of the housing.

The configuration of the radius link is such that a greater mechanical advantage is obtained than by connecting the shackle directly to the eccentric cam by only the connecting link.

BRIEF DESCRIPTION OF THE DRAWINGS

A better understanding of the device of the present invention may be had by reference to the drawings wherein.

DESCRIPTION OF THE EMBODIMENTS

Figure 2:
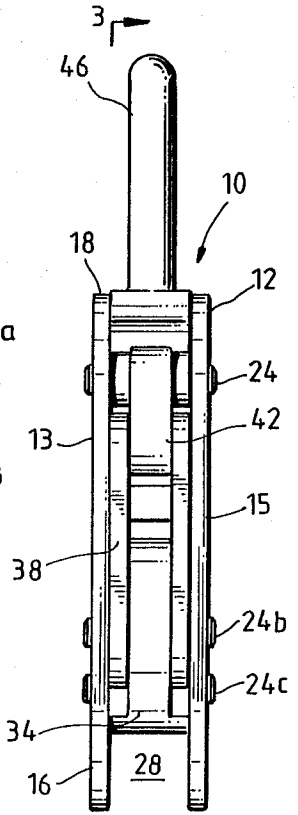
FIG. 2 is a side elevational view of the clamp shown in FIG. 1.
Figure 1:
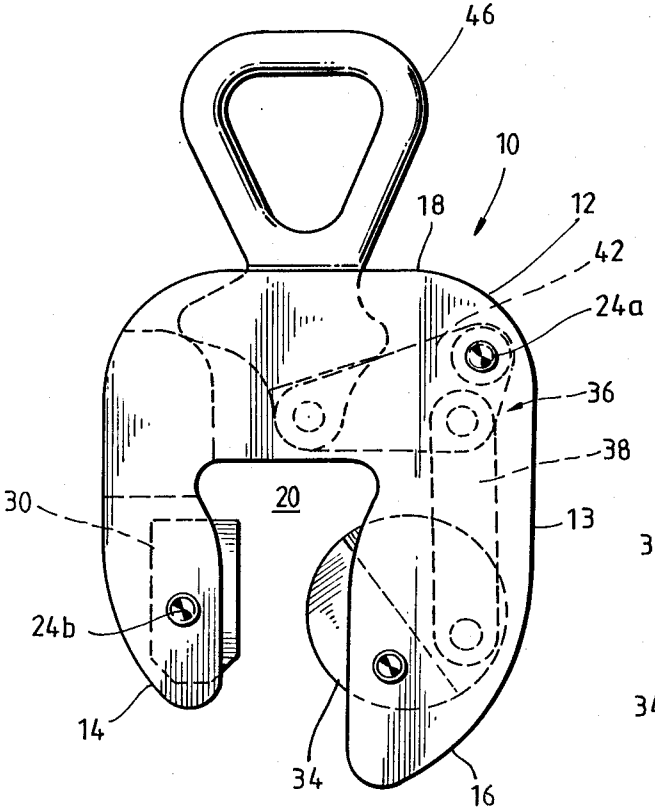
FIG. 1 is a front plan view of the lifting clamp of the present invention.

A better understanding of the lifting clamp 10 of the present invention may be had by reference to FIG. 1. Therein it may be seen that lifting clamp 10 and its operating parts are contained within a substantially U-shaped housing 12. U-shaped housing 12 is characterized by two leg members 14 and 16, a base member 18 and a throat 20. When it is desired to lift a metal plate or the like 22, the metal plate or the like 22 is inserted into throat 20 of U-shaped housing 12. Typically U-shaped housing 12 is formed from two plates 13 and 15 which are held together by pins **24*a*, 24*b* and 24*c* (FIGS. 2). Space 28 is formed between plates 13 and 15**.

Contained within housing 12 is swivel pad 30. Swivel pad 30 is mounted on pin **24*b* between plates 13 and 15 and is located so that it forms a positionable surface for metal plate or the like 22**.

Opposite swivel pad 30 is a toothless round cam 34 which is mounted eccentrically between plate 13 and 15 on pin **24*c*. Mounted to eccentric cam 34 by means of a pivot system 36 is connecting link 38. Connecting link 38, when moved, causes eccentric cam 34 to rotate around pin 24*c* and into throat 20 of housing 12. This rotating action causes metal plate or the like 22 to be pressed against swivel pad 30. When sufficient force is exerted on metal plate or the like 22, the frictional contact between eccentrically mounted cam 34 and swivel pad 30 is sufficient to lift the weight of metal plate or the like 22** and thus enable it to be moved from one position to another.

Figure 3:
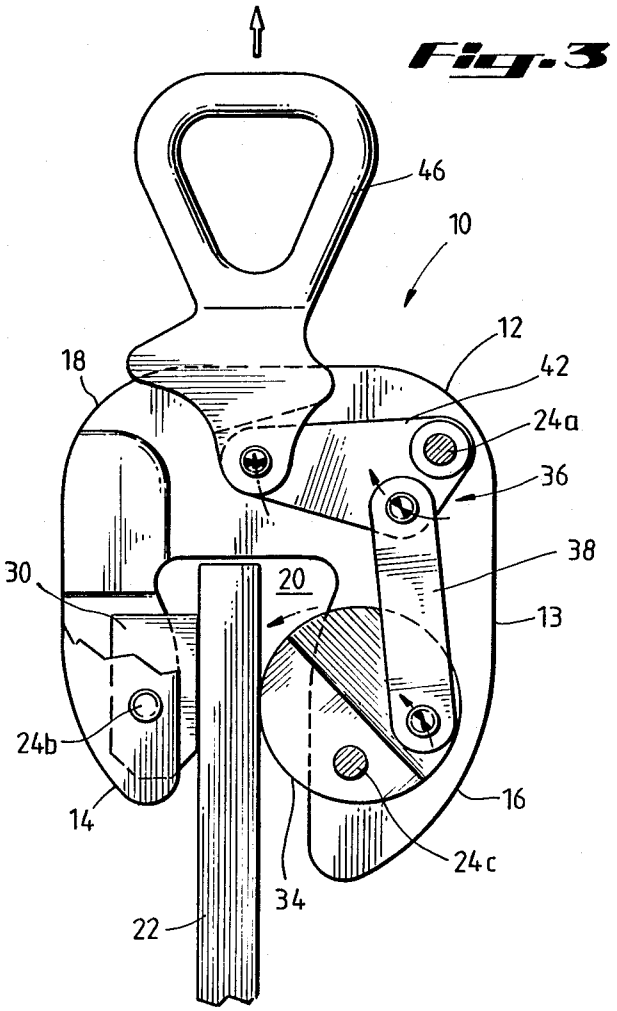
FIG. 3 is a schematic showing the movement of the mechanism within the housing.

Returning to connecting link 38, it may be seen by reference to FIGS. 1 and 3 that connecting link 38 is attached to radius link 42. Radius link 42 is pivotably mounted by pin 24a between plates 13 and 15. Radius link 42 is also connected to shackle 46. When force is exerted on shackle 46, it causes radius link 42 to rotate upwards on pin **24*a*. This upward rotation causes connecting link 38 to similarly move in an upward fashion. As connecting link 38 moves in an upward fashion, eccentrically mounted cam 34 is rotated into throat 20 of the U-shaped housing 12**.

The interposing of radius link 42 between shackle 46 and eccentrically mounted cam 34 provides a distinct mechanical advantage over merely mounting shackle 46 by means of connecting link 38 to eccentrically mounted cam 34.

This additional force is necessary when a toothless cam is used. Cams having teeth provide additional gripping force by means of the teeth which engage the surface of the metal plate or the like; however, as previously stated, cam teeth will both mar a smooth surface and cause difficulty when it is necessary to remove the clamp from the plate. When toothless cams are used, it is necessary to provide a greater force; consequently, the device of the present invention includes radius link 42 to provide an additional mechanical advantage whereby a greater force may be obtained.

There is thereby provided by the lifting system of the present invention a device which will lift heavy metal plates or the like and will not mar its surface.

As construction and operation of the present invention, the lifting clamp has now been taught by the foregoing specification to those of ordinary skill in the art; various modifications to the invention described above may be made without departing from the scope of the appended claims.

What is claimed is:

1. A material handling device comprising:

a substantially U-shaped housing having a first leg member, a second leg member, a base and a throat;

a substantially flat pad pivotably mounted to said first leg member, said pad extending partially into said throat;

a substantially circular toothless cam eccentrically mounted to said second leg member, said cam extending partially into said throat;

a connecting link pivotably attached to said substantially circular cam for moving said substantially circular cam partially into said throat;

a radius link pivotably mounted to said substantially U-shaped housing, said radius link constructed and arranged to move said connecting link by exerting a tensile force thereon;

a shackle pivotably mounted to said radius link;

whereby, when said shackle is moved said radius link exerts a tensile force on said connecting link so as to move said substantially circular cam partially into said throat.

2. In a material handling device for lifting metal plate or the like having a substantially U-shaped housing with a first leg member, a second leg member, a base and a throat, a shackle, a toothless plate engaging cam activated by the shackle, a substantially flat plate engaging pad, a connecting link for transmitting forces between the shackle and said plate engaging cam, the improvement comprising:

pivotably mounting a radius link to said substantially U-shaped housing between said connecting link and said shackle such that a tensile force is placed on said connecting link when the material handling device is used to lift metal plate or the like.

3. A method for lifing metal plate or the like comprising the steps of:

inserting said metal plate or the like into a substantially U-shaped housing, said substantially U-shaped housing having two leg members, a base and a throat;

pivotably mounting a toothless eccentric cam in one of said leg members;

pivotably mounting a substantially flat plate engaging pad in the other of said leg members;

pivotably mounting a radius link to said U-shaped housing;

pivotably mounting said radius link to a shackle;

pivotably mounting said radius link to a connecting link so that a tensile force is exerted on said connecting link;

pivotably mounting said connecting link to said eccentric cam;

exerting an upward force on said shackle;

whereby, when said upward force is exerted on said shackle, said radius link pivots with respect to said housing and moves said connecting link by exerting a tensile force thereon which in turn moves said toothless eccentric cam into the throat of said housing for frictional engagement with a metal plate or the like, said frictional engagement being sufficient to lift the metal plate or the like.

* * * * *